United States Patent [19]

Hade, Jr. et al.

[11] Patent Number: 4,809,472

[45] Date of Patent: Mar. 7, 1989

[54] CARRIER TRACK ASSEMBLY FOR EXTENSIBLE AND RETRACTABLE BOOM MACHINES

[75] Inventors: Donald C. Hade, Jr., Waynesboro; Robert D. Backer, Rouzerville, both of Pa.

[73] Assignee: Kidde Industries, Inc., Iselin, N.J.

[21] Appl. No.: 101,017

[22] Filed: Sep. 25, 1987

[51] Int. Cl.[4] ..... B66C 23/06; B66C 23/88

[52] U.S. Cl. ..... 52/118; 414/918; 182/2

[58] Field of Search ..... 52/115, 118, 117, 121, 52/632; 212/230, 242, 243, 251, 264, 267, 268; 414/918; 182/2; 187/9 E

[56] References Cited

U.S. PATENT DOCUMENTS

| | | | |
|---|---|---|---|
| 3,937,340 | 2/1976 | Grove | 182/2 X |
| 4,118,907 | 10/1978 | Small et al. | 52/118 X |
| 4,129,277 | 12/1978 | Tenniswood | 248/51 |
| 4,226,300 | 10/1980 | Rallis et al. | 182/2 |
| 4,360,077 | 11/1982 | Abbott | 182/2 |
| 4,470,229 | 9/1984 | Muse et al. | 52/118 |
| 4,506,480 | 3/1985 | Murrill et al. | 52/121 |
| 4,676,340 | 6/1987 | Correll, Jr. | 52/118 X |

FOREIGN PATENT DOCUMENTS

| | | | |
|---|---|---|---|
| 2106860 | 4/1983 | United Kingdom | 212/268 |

*Primary Examiner*—David A. Scherbel
*Assistant Examiner*—Richard E. Chilcot, Jr.
*Attorney, Agent, or Firm*—Brady, O'Boyle & Gates

[57] ABSTRACT

A carrier track assembly for extensible and retractable boom machines wherein the carrier track assembly is positioned within the telescopic boom sections and has one end connected to the extension and retraction fluid cylinder in the base boom section and the opposite end connected to the inner end of the next adjacent extensible and retractable boom section, the carrier track assembly being supported by the extension and retraction fluid cylinder when the boom sections are fully extended. An elevated support member is secured to the fluid cylinder at a position between the inner end of the base boom section and the end connection of the carrier track assembly on the fluid cylinder, the carrier track assembly being reversely bent upon itself and supported by the elevated support member when the boom sections are fully retracted.

12 Claims, 4 Drawing Sheets

X
X
5
6
7
8
9
10
12
13
14
17
18
19
20
21
22
23
24
25
26
27
29
30
31
32
33
34
35

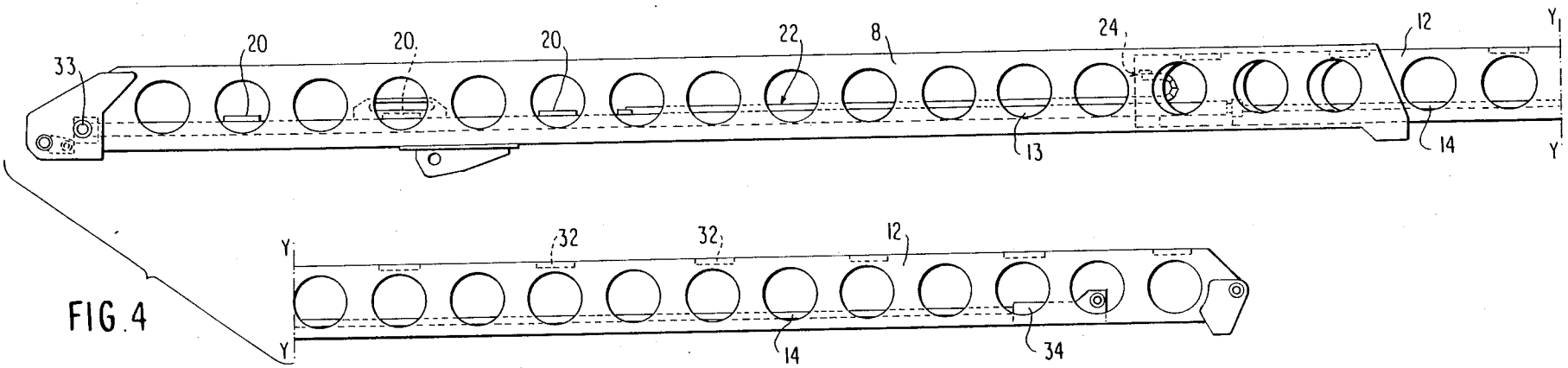
FIG. 4
FIG. 9
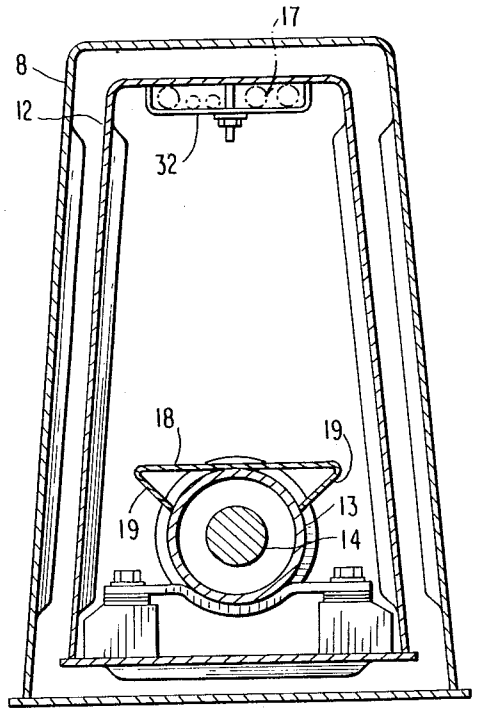
FIG. 8
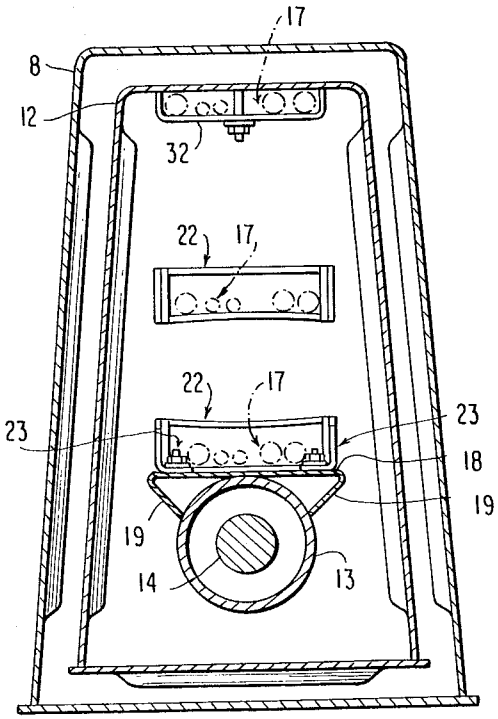

CARRIER TRACK ASSEMBLY FOR EXTENSIBLE AND RETRACTABLE BOOM MACHINES

BACKGROUND OF THE INVENTION

Various track assemblies have been proposed for extensible and retractable boom machines such as cranes, aerial work platforms and the like, for supporting flexible hoses and cables required for transmitting power to the work unit mounted on the outermost end of the telescopic boom. Conventional track assemblies include a flexible carrier constructed and arranged to bend at least 180° about its transverse axis but prevented in bending about the transverse axis in the opposite direction, whereby the carrier can be maintained in a substantially rigid linear position when the boom machine is fully extended but bent back upon itself when the boom machine is retracted.

Heretofore, the track assemblies have been supported on the telescopic sections by complicated and expensive support members and when mounted on the outside of the boom, the track assemblies are likely to become damaged. The object of the present invention is to provide a structure that overcomes the problems inherent with the prior art structures.

SUMMARY OF THE INVENTION

After considerable research and experimentation, the carrier track assembly of the present invention has been devised wherein the carrier track is not only wholly contained within the telescopic boom sections but also supported by the fluid cylinder during the extension and retraction of the boom sections. By this construction and arrangement, the carrier track and associated hoses and cables are protectively housed within the boom sections, and the fluid cylinder performs the two-fold function of extending and retracting the boom sections and providing a support for the carrier track.

BRIEF DESCRIPTION OF THE DRAWINGS

FIG. 4 is a side elevational view of the boom sections in the extended position, the drawing figure consisting of two portions which are joined longitudinally on the match line Y-Y;

FIG. 8 is a view taken along line 8—8 of FIG. 3;

FIG. 9 is a view taken along line 9—9 of FIG. 3; and

DESCRIPTION OF THE PREFERRED EMBODIMENT

Figure 1:
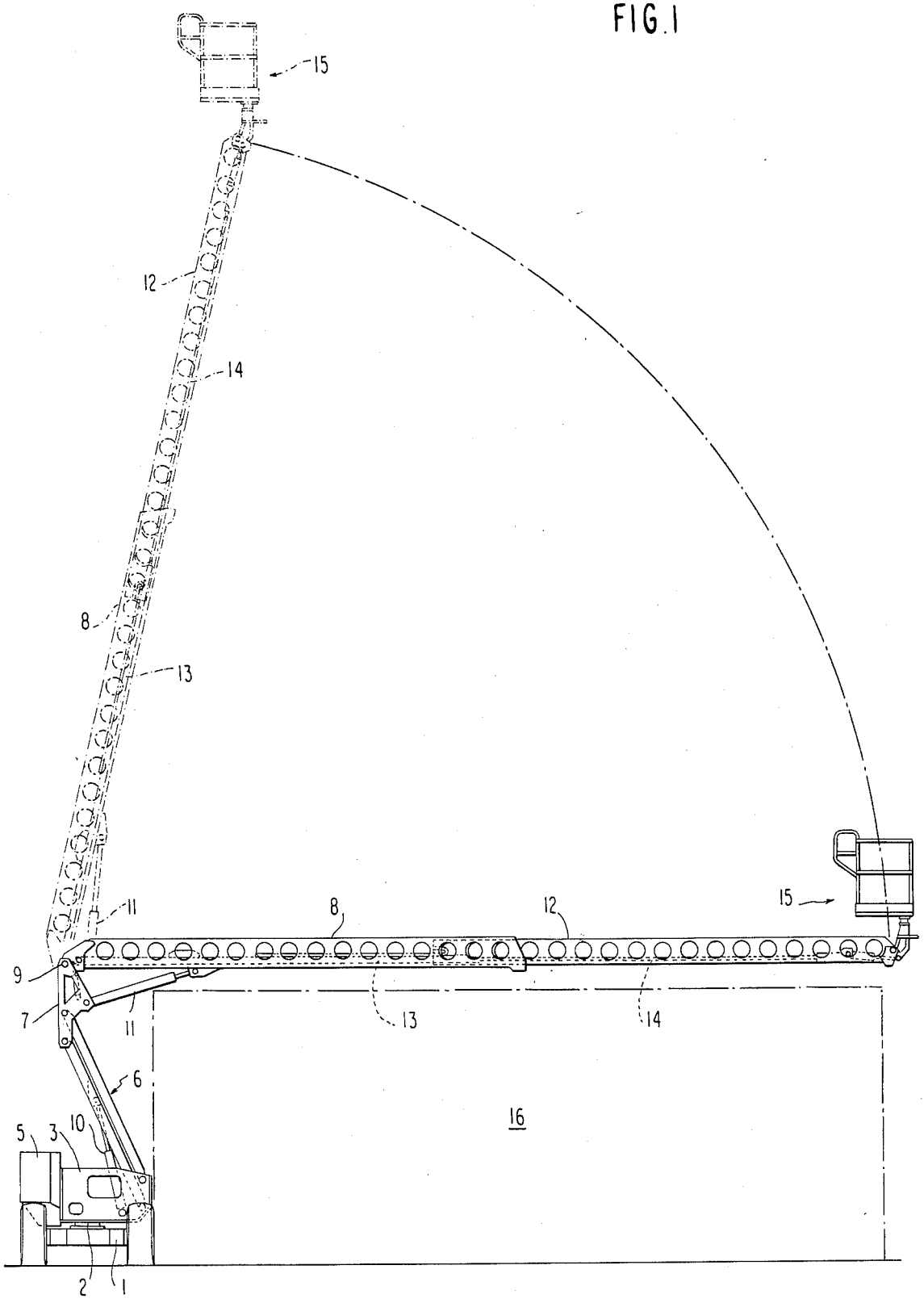
FIG. 1 is a side elevational view of an extensible and retractable boom machine having an aerial work platform mounted on the outermost end of a telescopic boom section, and employing the carrier track assembly of the present invention.

Referring to the drawings and more particularly to FIG. 1, by way of example an extensible and retractable boom machine is illustrated in which the carrier track assembly of the present invention is adapted to be employed. The machine comprises a self-propelled steerable vehicular base 1 having a turntable 2 on which is mounted a horizontally turnable body portion 3. A counterweight 5 is connected to one end of the body portion 3, and parallel linkages 6 are pivotally connected at their lower ends to the body portion 3, and at their upper ends to a frame member 7 to which the base section 8 of the boom is pivotally connected as at 9. A first luffing cylinder 10 is provided between the body portion 3 and the linkages 6, and a second luffing cylinder 11 is provided between the frame member 7 and the base section 8, whereby the boom can be moved to various positions within a vertical plane. An extensible and retractable boom section 12 is telescopically received within the base section 8 and the telescopic movement of the boom section is effected by a fluid cylinder 13 mounted within the base section 8 and a piston rod 14 extending from the cylinder 13 and having its outer end fixed to the boom section 12. An aerial platform 15 is connected to the end of the boom section 12 and includes conventional controls for moving and steering the vehicular base 1, the luffing and sluing of the linkages 6 and boom base section 8, and the extension and retraction of the boom section 12, whereby a worker on the platform can control the position and reach of the telescopic boom assembly relative to an obstruction 16 in the vicinity of the work area.

Figures 2, 3:
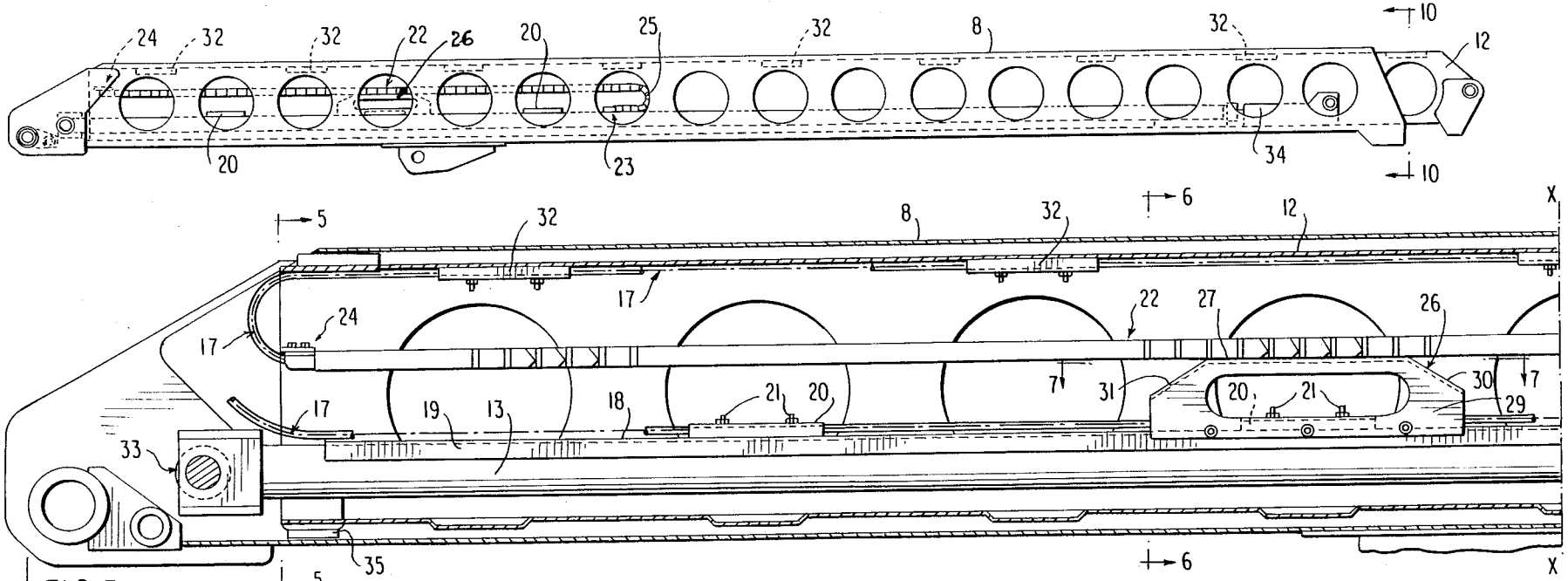
FIG. 2 is a side elevational view of the boom sections in the retracted position.
FIG. 3 is an enlarged side elevational view of the boom sections illustrated in FIG. 2, the drawing figure consisting of two portions which are joined longitudinally on the match line X-X.
Figure 5:
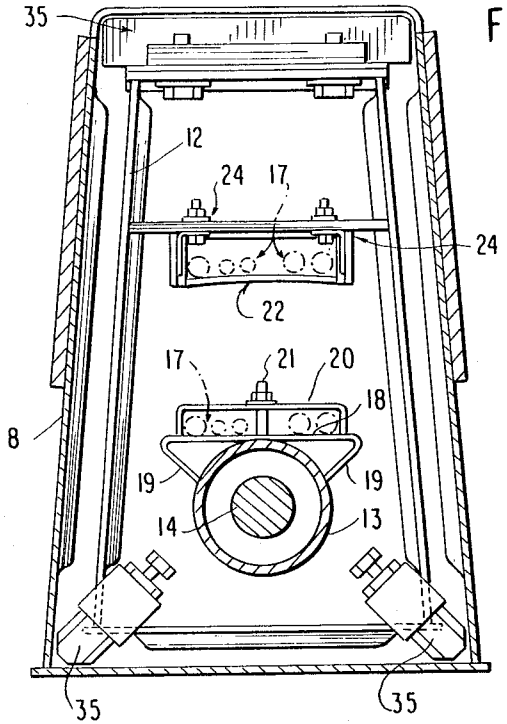
FIG. 5 is a view taken along line 5—5 of FIG. 3.

As will be seen in FIGS. 3 and 5, the various hoses and cables 17 for transmitting power to the aerial work platform 15 extend into the base section 8 from the inner end thereof and are supported by a shelf 18 having convergent side walls 19 welded to the cylinder 13. The hoses and cables 17 extend through a plurality of longitudinally spaced channels 20, bolted as at 21 to the shelf 18, to thereby retain the hoses and cables 17 on the shelf 18.

Referring to FIGS. 3, 4 and 8, it will be seen that after the hoses and cables 17 pass through the channels 20, they extend into and are supported by a conventional flexible carrier track 22 of the type disclosed in U.S. Pat. No. 4,129,277 to Tenniswood. The track 22 has its inner end secured to the shelf 18 as at 23 and its outer end secured as at 24 to the inner end of the next adjacent boom section 12, the track 22 having a reversely bent or bight portion 25, whereby when the boom section 12 is extended, as shown in FIG. 4, the track 22 and associated hoses and cables 17 are supported on the shelf 18 secured to the cylinder 13. When the boom section 12 is retracted, as shown in FIG. 2, the track 22 is folded back on itself, to thereby shorten the effective length of the hoses and cables 17.

Figure 6:
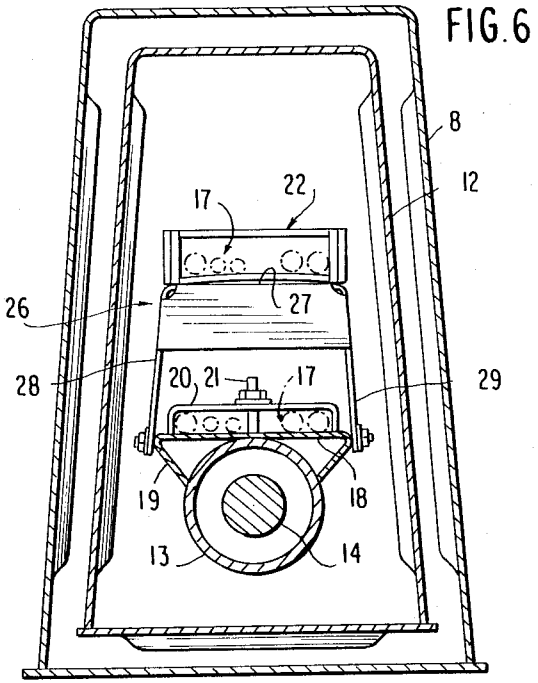
FIG. 6 is a view taken along line 6—6 of FIG. 3.
Figure 7:
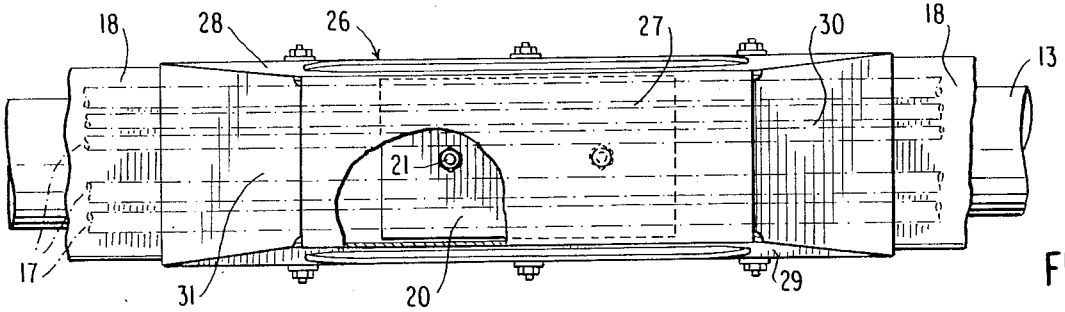
FIG. 7 is a view taken along line 7—7 of FIG. 3.

In order to prevent possible sagging of the track 22 when the boom section 12 is retracted, as will be seen in FIGS. 3, 6 and 7, an elevated support member 26 is provided at a position between the inner end of the base section 8 and the track connection 23. The support member comprises an inverted channel member having a web portion 27 upon which the track 22 rests, depending side walls 28, 29 secured to the edge portions of the shelf 18, and front and rear inclined wall portions 30, 31, respectively.

Figure 10:
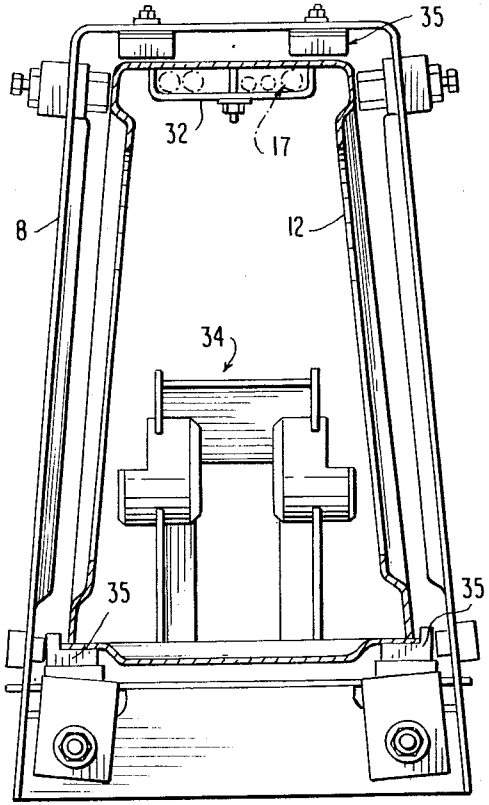
FIG. 10 is a view taken along line 10—10 of FIG. 2.

To complete the support of the hoses and cables 17 within the boom sections 8 and 12, as will be seen in FIGS. 2, 3 and 10, a plurality of longitudinally spaced channels 32, similar to channels 20, are bolted or otherwise suitably fastened to the top wall of boom section 12. The hoses and cables 17 extend through the channels 32 to the work unit, such as, the aerial platform 15, on the end of the boom section 12.

The remaining structure of the telescopic boom assembly is well understood by those skilled in the art and forms no part of the present invention, it being understood that the cylinder 13 remains fixed during the extension and retraction of boom section 12 and having its inner end secured to the inner end of the base section 8 as at 33, as shown in FIG. 3, and the free end of the piston rod being connected as at 34 to the boom section 12. Additionally, as will be seen in FIGS. 5 and 10, suitable slide bearings 35 are provided between the boom sections 8 and 12 to facilitate the telescopic movement of the boom section 12.

From the above description, it will be readily apparent to those skilled in the art that the carrier track 22 and associated hoses and cables 17 are protectively housed within the boom sections 8 and 12 during the telescopic movement of the boom section 12, and the fluid cylinder 13 is employed for not only extending and retracting the boom section 12 but also as a support for the carrier track when the boom section is in an extended and retracted position.

The carrier track 22 thus consists of a bottom flight portion and a top flight portion joined by a reversely bent or rolling bight portion 25. As the boom section 12 is extended the rolling bight portion 25 moves outwardly away from its inner end 23 and away from the elevated support member 26, during which the length of the bottom flight portion increases while the length of the top flight portion decreases. During this boom extension movement the top flight portion slides outwardly over the top of web portion 27 of support member 26 and the outer end of the carrier track will eventually pass over the top of web portion 27. After this, the length of the top flight portion will be reduced to a length that is self supporting without appreciable sagging or with no sagging, and the bottom flight portion continues to increase in length and be laid in supported linear position on the shelf 18 in a direction outwardly from and away from elevated support member 26. In the fully extended position of the boom the bottom flight portion comprises substantially the full length of the carrier track, as shown in FIG. 4, and in this position the carrier track is substantially fully supported on the shelf 18 outwardly from and away from the elevated support member 26.

Flexible carrier track 22 is of a construction that is readily available from different manufacturers and may be constructed of metal or of plastics for greater saving in weight. The track links are constructed to pivot relative to each other in one direction but not in the opposite direction so that the top flight is somewhat self supporting over short distances. Some track constructions will sag more than others in the retracted position of the boom and while a single elevated support member 26 is shown in the drawings, it is understood that two or more support members 26 may be provided, such as, for example, two additional elevated support members 26 connected over top of the channels 20 in FIG. 2 on each side of the single elevated support member 26 shown.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A carrier track assembly for extensible and retractable boom machines comprising, a base boom section, an extensible and retractable boom section slidably mounted in said base boom section, extensible and retractable power means, operatively connected between the boom sections for extending and retracting the second mentioned boom section, a carrier track mounted within said boom sections, hoses and or cables within said boom sections, said hoses and or cables being supported by said carrier track, one end of said carrier track being connected to said power means, and the opposite end of said carrier track being connected to the inner end of said second mentioned boom section, said carrier track having a reversely bent portion between the ends thereof, whereby when the second mentioned boom section is extended the carrier track is supported on the power means in a substantially rigid linear position, and when the second mentioned boom section is retracted the carrier track is folded back on itself and supported by said power means.

2. A carrier track assembly according to claim 1, wherein the power means comprises a fluid cylinder fixedly mounted in said base boom section, and a piston rod having its free end connected to the second mentioned boom section, the carrier track being supported by the fluid cylinder.

3. A carrier track assembly according to claim 2, wherein an elevated support member is secured to the fluid cylinder for supporting the folded back portion of the carrier track when in the retracted position.

4. A carrier track assembly according to claim 2, wherein a longitudinally extending shelf is fixedly secured to the fluid cylinder for supporting the hoses and or cables and the carrier track within the base boom section.

5. A carrier track assembly according to claim 4, wherein a plurality of longitudinally spaced channel members are secured to the shelf for holding the hoses and or cables thereon.

6. A carrier track assembly according to claim 1, wherein a plurality of longitudinally spaced channel member are secured to the interior surface of the top wall of the second mentioned boom section, the hoses and or cables extending through said channel members.

7. A carrier track assembly according to claim 3, wherein the elevated support member comprises an inverted channel member having depending side walls fixedly connected to the cylinder, the web portion of said inverted channel member supporting the folded back portion of the carrier track.

8. A carrier track assembly according to claim 4, wherein said base boom section has an inner end and said fluid cylinder has a top surface, said shelf is connected on the top surface of said fluid cylinder and extends substantially the length thereof, said one end of said carrier track connected to a medial portion of said shelf, said reversely bent portion comprising a rolling bight portion and in the retracted position of said second mentioned boom section is positioned substantially adjacent to and outwardly of said one end of said carrier track, said fluid cylinder connected to the inner end of said base boom section, and an elevated support member connected to said shelf between the connection of said fluid cylinder to the inner end of said base boom section and said one end of said carrier track for supporting the folded back portion of said carrier track in the retracted position in a linear position.

9. A carrier track assembly according to claim 8, wherein said rolling bight portion is curved away from said elevated support member, and said one end of said carrier track is connected to said shelf between said rolling bight portion and said elevated support member and is spaced a substantial distance outwardly from said elevated support member.

10. A carrier track assembly according to claim 8, wherein said elevated support member comprises an inverted channel member having depending side walls connected to said shelf and a substantially flat top surface portion supporting the folded back portion of the carrier track in retracted position of said second mentioned boom section.

11. A carrier track assembly according to claim 8, in which said carrier track comprises a bottom flight portion between said one end and said rolling bight portion, and a top flight portion between said rolling bight portion and said opposite end, said bottom flight portion supported in a linear position on said shelf in both extended and retracted position of said second mentioned boom section.

12. A carrier track assembly according to claim 11, wherein the bottom flight portion in the extended position of said second mentioned boom section comprises substantially the entire length of said carrier track which is supported on said shelf spaced outwardly of and extending away from said elevated support member.

* * * * *